US008587223B2

(12) United States Patent
Ilyes et al.

(10) Patent No.: US 8,587,223 B2
(45) Date of Patent: Nov. 19, 2013

(54) POWER LINE COMMUNICATION METHOD AND APPARATUS FOR LIGHTING CONTROL

(75) Inventors: Laszlo Sandor Ilyes, Richmond Heights, OH (US); David Joseph Tracy, West Lafayette, IN (US)

(73) Assignee: General Electric Company, Schenectady, NY (US)

( * ) Notice: Subject to any disclaimer, the term of this patent is extended or adjusted under 35 U.S.C. 154(b) by 486 days.

(21) Appl. No.: 12/907,549

(22) Filed: Oct. 19, 2010

(65) Prior Publication Data

US 2012/0091915 A1 Apr. 19, 2012

(51) Int. Cl.
*H05B 37/02* (2006.01)

(52) U.S. Cl.
USPC ..... 315/308; 315/307; 315/291

(58) Field of Classification Search
USPC ..... 315/307
See application file for complete search history.

(56) References Cited

U.S. PATENT DOCUMENTS 5,107,184 A 4/1992 Hu et al.
7,307,514 B2 12/2007 McAden
7,548,223 B2 6/2009 Brooksby et al.
2008/0157939 A1* 7/2008 Sutardja ..... 340/310.12
2011/0043124 A1 2/2011 Johnston et al.

FOREIGN PATENT DOCUMENTS

EP 0038877 A1 4/1980
EP 0471215 A1 7/1991
EP 2280585 A2 7/2010

OTHER PUBLICATIONS

Hunckler, Jose, PCT Search report, Written Opinion of The International Searching Authority, Dec. 14, 2011.*
International Search Report, Dec. 23, 2011.
Written Opinion, Dec. 23, 2011.

* cited by examiner

*Primary Examiner* — Douglas W Owens
*Assistant Examiner* — Devan A Clark
(74) *Attorney, Agent, or Firm* — Fay Sharpe LLP

(57) ABSTRACT

A transmitter apparatus and a ballast/driver receiver apparatus are presented for transmitting control information through a lighting system power line connection to a ballast or driver in which the transmitter selectively interrupts power delivery in select AC line power cycles to indicate data of a first binary state an uninterrupted power cycles indicate a second binary state with the receiver decoding the message data bits of different binary states based at least partially on the interruptions.

31 Claims, 5 Drawing Sheets

| | Prefix | Data to Follow | Action |
|---|---|---|---|
| 232a | 0101 | Dimming Level | Dim to the following dimming level, always |
| 232b | 0110 | Dimming Profile | Dim according to the following profile after a power-on (up to 16 profiles) |
| 232c | 0010 | Profile Index | Jump to the following index position in the current profile |

420

POWER LINE COMMUNICATION METHOD AND APPARATUS FOR LIGHTING CONTROL

BACKGROUND OF THE DISCLOSURE

Remote control of electronic ballasts and/or LED drivers via the power line connections allows improved functionality without additional control wiring. Conventional power line carrier (PLC) circuits transmit a modulated high frequency carrier signal through the power wiring to which a lighting system ballast is connected. However, this communication technique requires filter trapping to confine the signal to the targeted ballasts, and the ballast must have a receiver to interpret signals that are superimposed on the power line. Moreover the carrier signal may be significantly attenuated by inherent filtering properties of the power lines over which they are transmitted. Accordingly, conventional power line communications systems are expensive and unreliable. Thus, there remains a need for improved communications systems to provide control information to lighting ballasts using existing power lines.

SUMMARY OF THE DISCLOSURE

Transmitter and receiver apparatus and techniques are provided for transmitting control information to a ballast or driver in which the transmitter selectively interrupts power delivery in select AC line power cycles to indicate data of a first binary state and uninterrupted power cycles indicate a second binary state with the receiver decoding the message data bits of different binary states based at least partially on the interruptions.

A transmitter apparatus is provided, including a first terminal coupled with an AC power source and a second terminal coupled with a power connection that is connected to one or more lighting ballasts or drivers. The transmitter includes a switching circuit coupled between the first and second terminals to selectively couple the AC source to the ballasts/drivers in a first state and to interrupt the power delivered to the ballast or driver in a second state. A transmit controller transmits binary messages to the ballast or driver via the power connection, with bits of a first binary state transmitted by placing the switching circuit in the second state for a predetermined time period to interrupt provision of power from the AC power source in at least one portion of select AC input cycles.

In certain embodiments, the controller transmits bits of a second binary state by maintaining the switching circuit in the first state to allow uninterrupted power from the AC power source to flow to the ballast or driver.

In certain embodiments, the transmit controller provides the switching control signal to selectively interrupt power in portions of both half-cycles of the select AC input cycles. In certain embodiments, each bit of the message corresponds to an AC input cycle.

In certain embodiments, the transmit controller synchronizes the selective power interruption with a zero crossing of the power from the AC power source, and the transmitter apparatus may include a sync circuit providing a sync signal to the transmit controller indicating a zero crossing of the power from the AC power source.

In certain embodiments, the binary message includes a prefix portion and a data portion with the prefix portion indicating the type of data included in the data portion. In certain embodiments, the message includes a dimming level value indicating a dimming level to be used by the ballast or driver. In certain embodiments, the message includes a dimming profile value indicating a predefined dimming profile to be used by the ballast or driver. In certain embodiments, the message includes a dimming profile index value indicating a predefined index within a dimming profile to be used by the lighting ballast or driver.

In certain embodiments, the transmit controller enters the transmit mode in response to an input from one or more sensors, such as a photo sensor or an occupancy sensor, and/or in response to an input from a user interface.

In certain embodiments, the transmitter apparatus includes a communications interface providing communications between the transmit controller and an external device.

The transmitter apparatus in certain embodiments includes a second switching circuit coupled between the first and second terminals, and the transmit controller selectively operates the second switching circuit to connect the AC power source to the ballast or driver in a bypass mode.

A method is provided for communicating with a ballast or driver through a lighting system power connection. The method includes connecting a switching circuit between a an AC power source output and a first power connection coupled with alighting ballast or driver, and transmitting a binary message to the ballast or driver using the switching circuit with bits of a first binary state being transmitted by interrupting the provision of power from the AC power source to the ballast or driver for a predetermined time period in at least one portion of select AC input cycles. In certain embodiments, bits of the first binary state are transmitted by interrupting power in portions of both half-cycles of the select AC input cycles. In certain embodiments, bits of a second binary state are transmitted by maintaining provision of power from the AC power source. En certain embodiments, the binary message is transmitted with each bit of the message corresponding to an AC input cycle. Certain embodiments, moreover, include synchronizing the interruption with a zero crossing of the power from the AC power source.

A lighting system ballast or driver apparatus is provided, which includes a main power conversion system with a controller operating one or more power conversion components and a receiver that detects input power interruptions. In certain embodiments, the apparatus is a ballast, where the main power conversion system includes an inverter providing AC power to one or more lamps. In certain embodiments, the apparatus is a lighting system driver, where the main power conversion system includes a DC to DC converter providing DC power to an LED array. The receiver includes a receiver controller which decodes message data bits of different binary states based at least in part on the interruptions and provides decoded message data to the ballast or driver controller.

In certain embodiments, the receiver controller decodes interrupted AC cycles as bits of a first binary state and decodes uninterrupted AC cycles as bits of a second binary state, with each bit of the message corresponding to an AC input cycle.

In certain embodiments, the receiver controller provides decoded message data to the ballast or driver controller including a prefix portion and a data portion, with the prefix portion indicating a type of data included in the data portion. In certain embodiments, the receiver controller provides decoded message data to the ballast or driver controller including a dimming level value. In certain embodiments, the receiver controller provides decoded message data to the ballast or driver controller including a dimming profile value indicating a predefined dimming profile. In certain embodiments, the receiver controller provides decoded message data to the ballast or driver controller including a dimming profile index value indicating a predefined index within a dimming profile.

BRIEF DESCRIPTION OF THE DRAWINGS

One or more exemplary embodiments are set forth in the following detailed description and the drawings, in which.

DETAILED DESCRIPTION OF THE PREFERRED EMBODIMENTS

Figure 1:
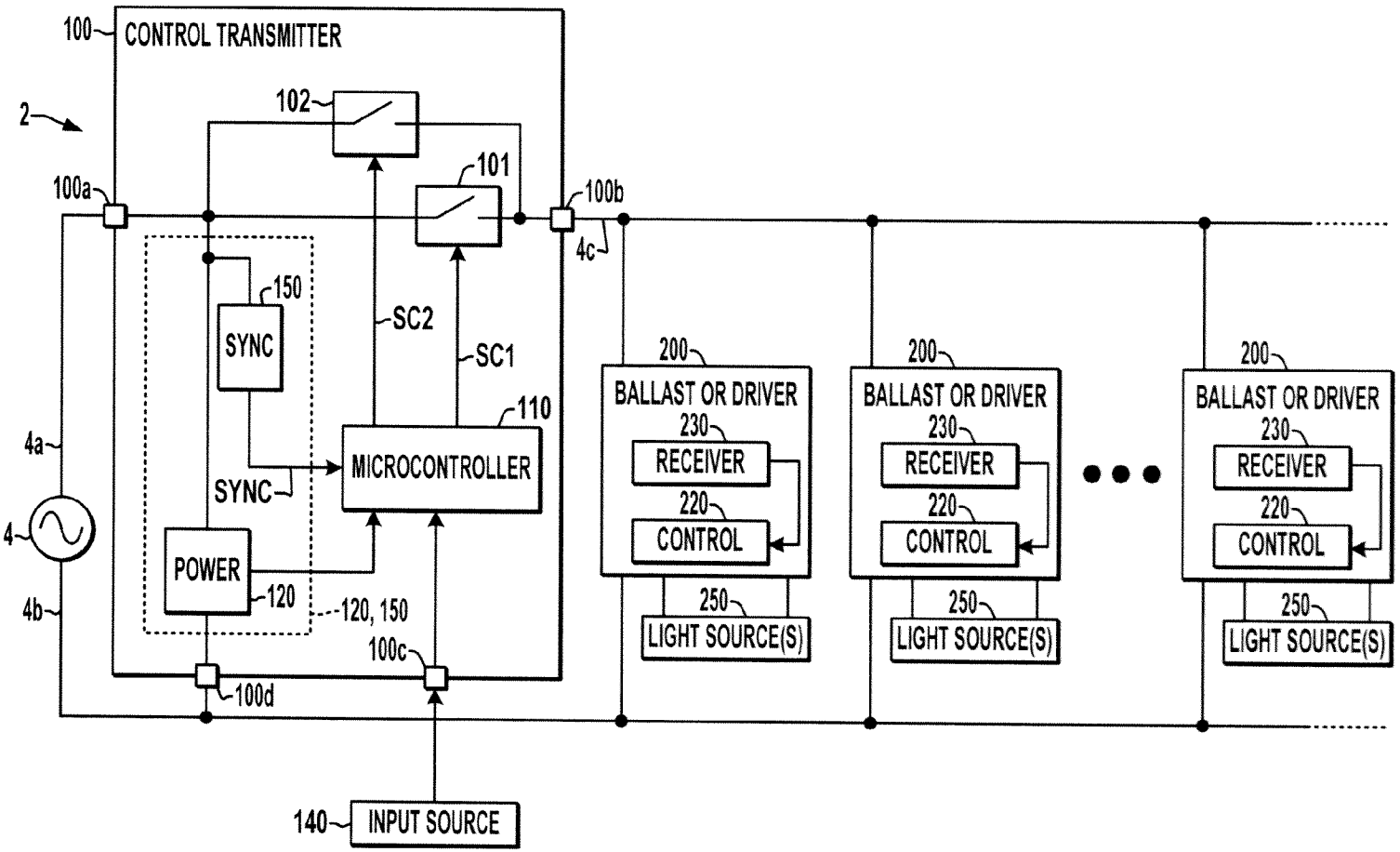
FIG. 1 is a schematic system diagram illustrating an exemplary lighting system with a control transmitter and ballasts or drivers with receivers for communicating data messages to the ballasts/receivers via a power line connection.
Figure 2:
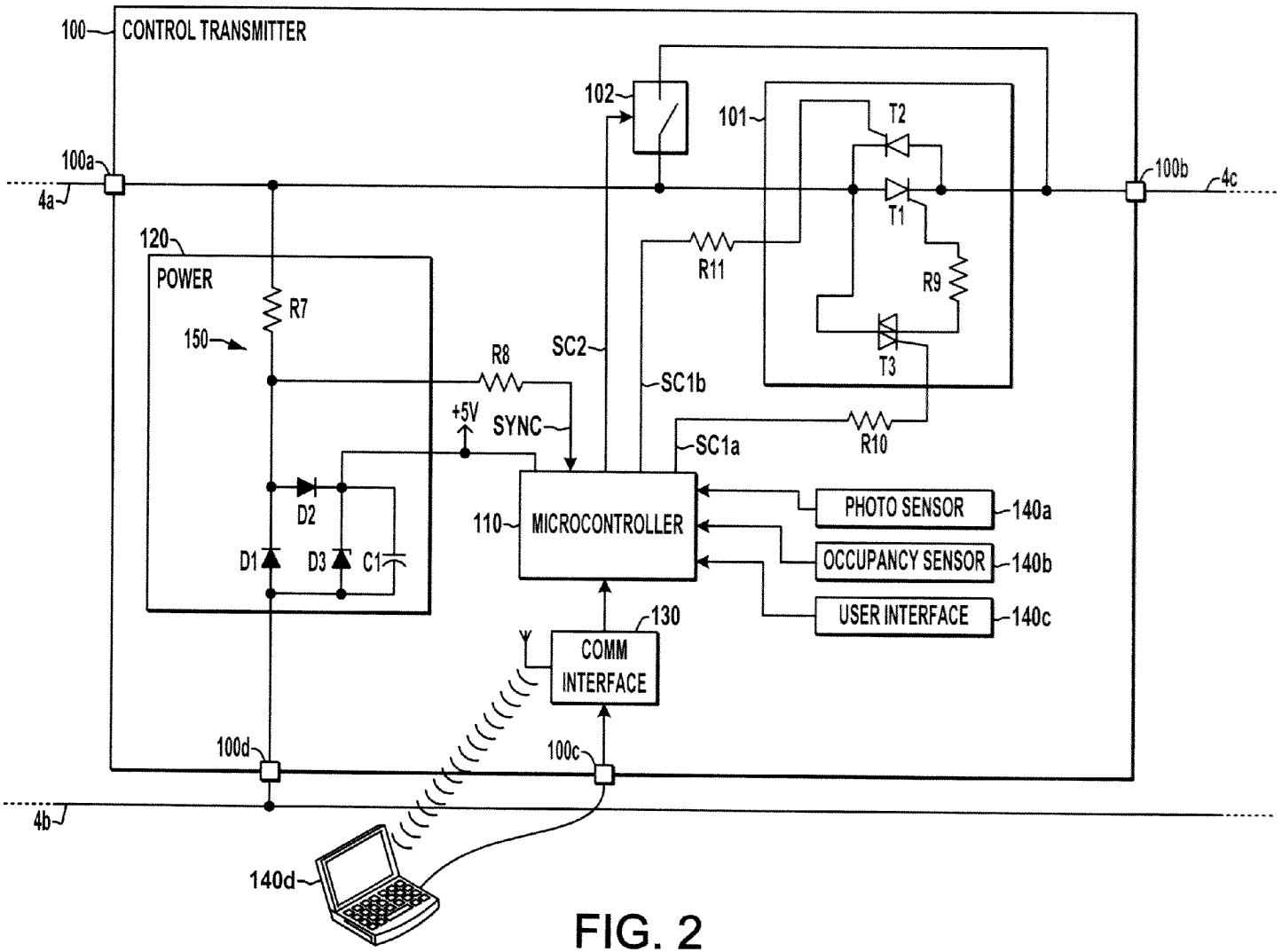
FIG. 2 is a schematic diagram illustrating further details of an exemplary control transmitter apparatus in the system of FIG. 1.
Figure 3:
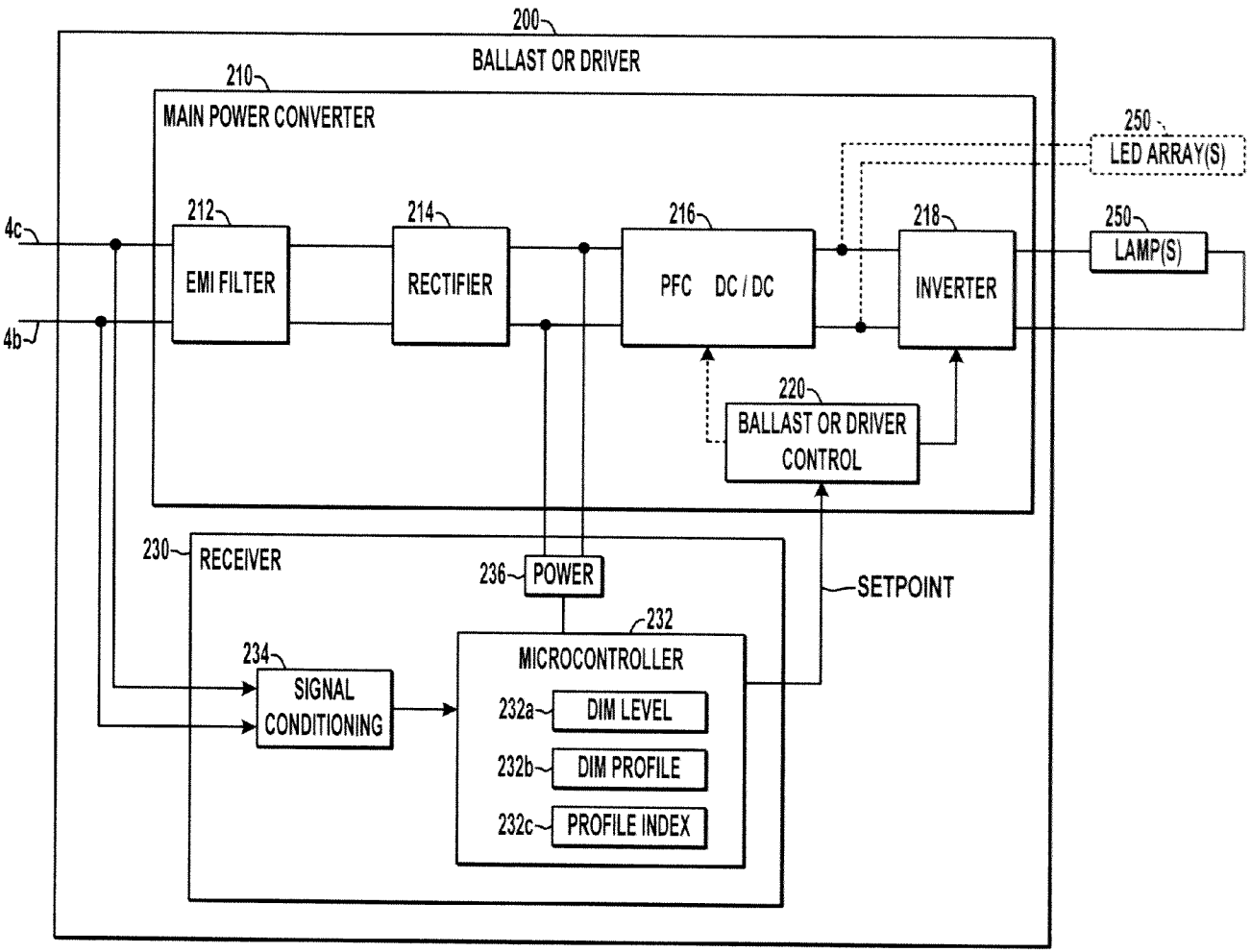
FIG. 3 is a schematic diagram illustrating further details of an exemplary ballast/driver receiver in the system of FIG. 1.

Referring now to the drawings, where like reference numerals are used to refer to like elements throughout, and wherein the various features are not necessarily drawn to scale, the present disclosure relates to communications techniques and apparatus for communicating with lighting system drivers or ballasts using power lines by selective interruption of provided power. FIG. 1 illustrates a lighting system 2 equipped with a control transmitter apparatus 100 connected between an AC power source 4 and several ballasts or drivers 200 having receivers 220 in which one or more aspects of the disclosure may be carried out. FIG. 2 illustrates further details of an exemplary control transmitter 100 and FIG. 3 shows further details of an exemplary ballast/driver receiver apparatus in the system of FIG. 1. The control transmitter apparatus 100 communicates with the ballasts or drivers 200 through lighting system power connection 4*c* (e.g., power line) in which load-side power connections 4*b* and 4*c* are energized by the AC source 4 and the transmitter apparatus 100 selectively interrupts portions of select AC power cycles to indicate message bits of a first binary state for sending messages to the ballasts/drivers 200. This is in contrast to conventional power line carrier (PLC) techniques in which a carrier is superimposed onto the otherwise continuous line power waveform. As seen in FIG. 1, the ballasts/drivers 200 individually include receiver circuits 230 and power control elements 220 controlling power provided to lamp or LED light sources 250 as further detailed in FIG. 3 below.

As best shown in FIGS. 1 and 2, the transmitter apparatus 100 includes a power circuit 120 deriving power from the AC source 4 via connections 4*a* and 4*b* through terminals 100*a* and 100*d* for the AC line and neutral, respectively, and the circuit 120 powers a transmit controller 110, such as a PIC16F690IP microcontroller from Microchip Technology in one embodiment. The apparatus 100 provides first and second terminals 101*a* and 101*b* connected respectively to the line output 4*a* of the AC source 4 and to the load side connection 4*c* coupled with first terminals of the ballasts/drivers 200. Two switching circuits 101 and 102 are connected in parallel with one another between the first and second terminals 101*a* and 101*b*. As discussed further below, the first switching circuit 101 in certain embodiments is a semiconductor-based switching device or devices operable to turn on and off quickly relative to the frequency of the AC source 40, and the optional second switching circuit 102 is used as a low impedance bypass switch to provide a low impedance conductive connection from the AC source 4 to the ballasts/drivers 200 in a bypass mode when the transmitter 100 is not sending messages to the ballasts/drivers 200.

The illustrated transmitter 100 further includes a sync circuit 150 coupled with the first terminal 100*a* which provides a signal SYNC to the transmit controller 110 to indicate a zero crossing of the power from the AC power source 4. In one embodiment, the sync signal may be entirely derived from the power circuit 120, thus combining circuits 120 and 150 into a single circuit. In operation, the controller 110 provides switching control signals SC1 and SC2 to operate the switching circuits 101 and 102, respectively, where the first switching circuit 101 is used for selectively interrupting the provision of power to transmit message data to the ballasts/drivers 200. In particular, the switching circuit 101 is operable according to the switching control signal SC1 from the controller 110 to selectively electrically couple the first terminal 100*a* to the second terminal 100*b* in a first (ON) state, and to electrically decouple the first terminal 100*a* from the second terminal 100*b* in a second (OFF) state.

In the embodiment of FIG. 2, the switching circuit 101 includes SCRs T1 and T2 (e.g., S4004VS1 in certain embodiments) and a triac T3 (e.g., L4004L3 in one embodiment) to facilitate interrupting the provision of power in either or both half-cycles of the AC input power, although certain embodiments can provide for selective interruption of only portions of one half-cycle (positive or negative) of the AC input power from the source 4. In this example, a pair of opposite switching signals SC1*a* and SC1*b* are provided by the controller 110, with SC1*a* driving the control terminal of the triac T3 through a resistor R10 (e.g., 1 kOHM) to drive the control terminal of SCR T1 through a 10 kOHM resistor R9, while SC1B drives the control terminal of SCR T2 through a 10 kOHM resistor R11. In other embodiments, different types and configurations of switching devices can be used, including without limitation one or more triacs, SCRs, power MOSFETs, solid-state relays, or combinations thereof.

The embodiment of FIGS. 1 and 3 also includes a second switching circuit 102, such as a relay or semiconductor-based switching device or devices, with a controlled conduction path coupled between the first and second terminals 100*a* and 100*b*. The switch 102 is operable according to a second switching control signal SC2 provided by the controller 110 to selectively electrically couple the first terminal 100*a* to the second terminal 100*b* in a first (ON or closed) state. In a bypass mode, the transmit controller 110 provides the signal SC2 to selectively place the second switching circuit 102 in the first state to connect the AC power source 4 to the at least one lighting ballast or driver 200. In this manner, the second switching circuit 102 can provide low impedance power conduction from the source 4 to the ballasts/drivers 200 to mitigate power losses associated with the first switching circuit 101.

In this embodiment, moreover, the sync circuit 150 is coupled between the first terminal 100*a* (line) and a fourth terminal 100*d* (neutral) and includes diodes D1 and D2 (e.g., 1N4005) and a zener D3 (e.g., 1N4734) as well as a capacitor C1 (220 μF) and resistors R7 and R8 (e.g., 5 kOHM and 100 kOHM, respectively) and provides a signal SYNC indicating to the transmit controller 110 the zero crossings of the power from the source 4.

Referring also to FIG. 3, a graph 300 shows the load-side line voltage on connection 4*c* for several exemplary power cycles during transmission by the control transmitter apparatus 100. In this case, the input power is provided by the source 4 at a frequency of 60 Hz with a corresponding sinusoidal power cycle period T of 16.67 ms. The transmit controller 110 operates in a transmit mode or in a non-transmit or bypass mode and provides the switching control signals SC1 and SC2 to control the provision of power from the source 4 to the ballasts/drivers 200. In the transmit mode, the controller 110 provides SC1 with SC2 set to deactivate the second (bypass) switch 102 (switching circuit 102 OFF) to transmit a binary message 410 (FIG. 7) including a plurality of bits via the first power connection 4*c* to the ballasts/drivers 200, in which bits of a first binary state "0" are created by providing the switching control signal SC1 to selectively place the switching circuit 101 in the second state (OFF or open) for a predetermined time T(+) in the first (positive) half-cycle and likewise to place the switch 101 in the second (OFF) state for a predetermined time T(−) in the second (negative) half-cycle, where the times T(+) and T(−) may, but need not, be equal. In the illustrated example for a 60 Hz line frequency, the times T(+) and T(−) are about 4 ms or less, such as about 1-2 ms in certain embodiments. In this range, the RMS power delivered to the ballasts/drivers 200 is maintained at a level sufficient to ensure correct ballast/driver operation while generating a reliable, dependent, message transmission to the receivers 230 of the ballasts/drivers 200 by interrupting the provision of power from the AC power source 4 to the ballasts/drivers 200 in at least one portion of select AC input cycles.

Figure 4:
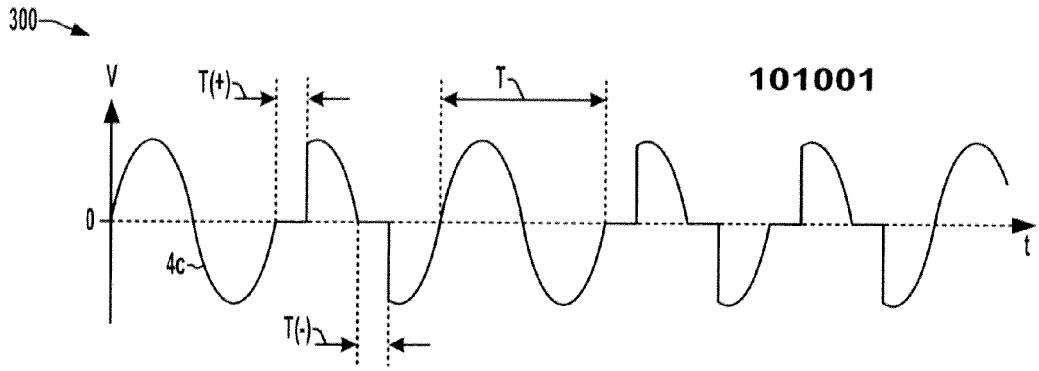
FIGS. 4-6 are waveforms illustrating different examples of selective interruption for power line communications in the system of FIG. 1.
Figure 5:
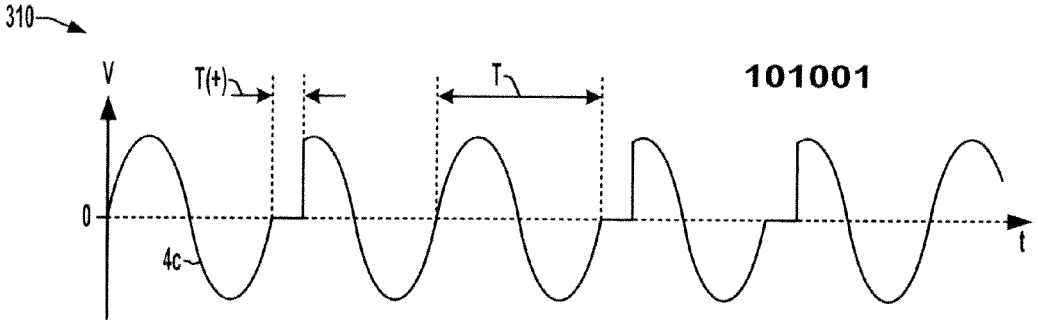
Figure 6:
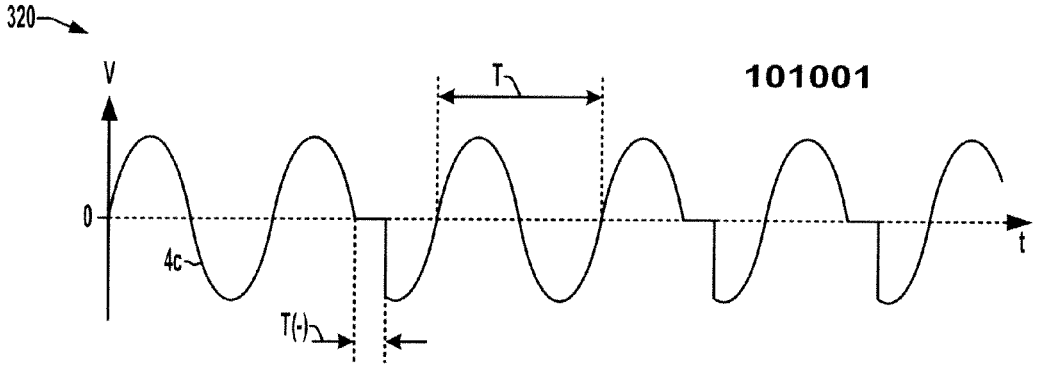

In this regard, the provision of the interruption in both half-cycles of the select power cycles advantageously facilitates detection by the receivers 230 in the ballasts/drivers 200 and accommodates possible wiring reversals in the receivers 230. Graph 310 in FIG. 5 shows another possible embodiment in which the interruptions are provided in only the positive half-cycles for a period T(+). Still another example is shown in the graph 320 of FIG. 6 in which a portion of duration T(−) in select negative half-cycles are interrupted by the switching circuit 101 by operation of the control signal SC1. Six exemplary power cycles are shown in FIGS. 4-6, corresponding to binary states 101001, with the uninterrupted cycles corresponding to binary "1" and the interrupted cycles corresponding to binary "0". In other possible embodiments, selective interruption can be used in both binary states, for instance, with a short interruption corresponding to a first binary state and a longer interruption indicating a second binary state. In other possible implementations, interruption in a positive half cycle can be used to indicate one data state with interruptions in a negative half-cycle being used to indicate a different data state.

Figure 7:
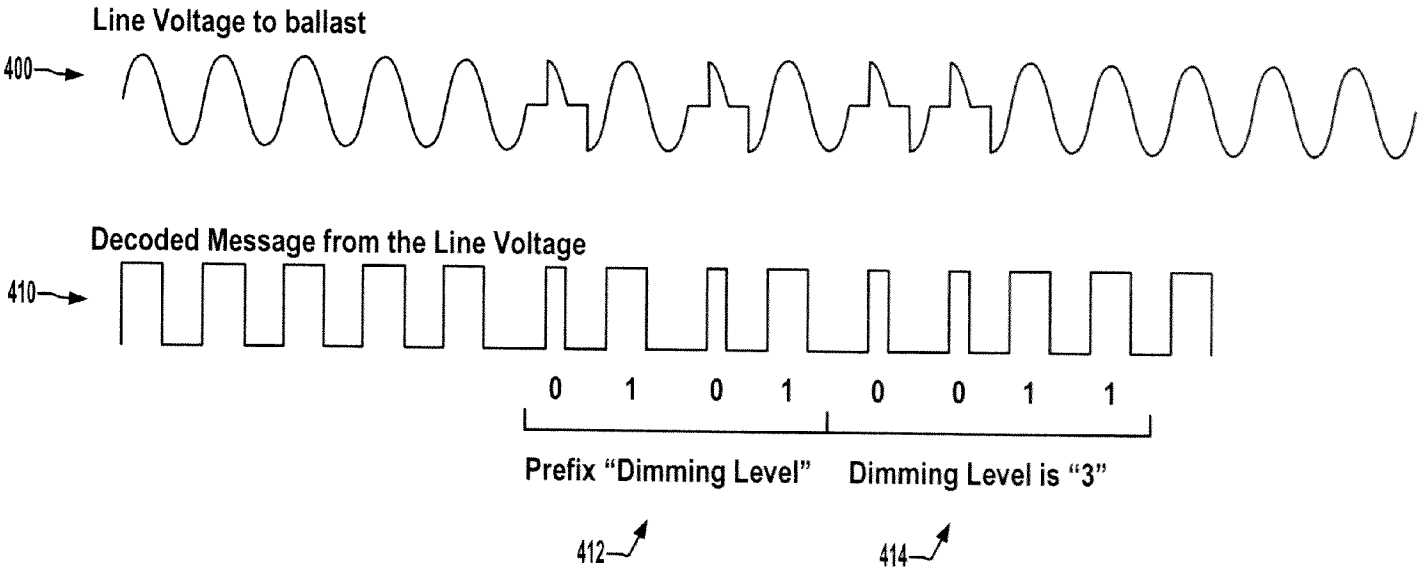
FIG. 7 illustrates exemplary waveform decoding in the receiver of FIGS. 1 and 3.

Referring also to FIGS. 3 and 7, as noted above, the exemplary implementations utilize a configuration with each AC power cycle corresponding to a data bit, where the transmit controller 110 selectively includes interrupt periods T(+), T(−) synchronized with the detected zero crossings of the AC power according to the SNYC signal from the sync circuit 150. The transmitter apparatus 100 can be used to convey any type of information to one or more of the ballasts/drivers 200. FIG. 7 shows an exemplary waveform 400 at the line-side power connection 4*c* and a decoded waveform 410 in the receiver 230 of one of the ballast/drivers 200, in which a given message is eight binary bits including a prefix 412 and a data portion 414, with the prefix portion 412 indicating a type of data included in the data portion 414. FIG. 7 also shows a table 420 illustrating exemplary prefixes "0101", "0110", and "0010" used by the transmitter 100 in FIGS. 1 and 2. These example 4-bit prefixes 412 indicate to the receivers 230 that the following four data bits are of a certain type, in this case a dimming level value 232*a* indicating a dimming level to be used by the ballast/drivers 200, a dimming profile value 232*b* indicating a predefined dimming profile to be used by the at least one lighting ballast or driver 200 (e.g., a set of predefined setpoint dimming levels and corresponding dwell times, ramp portions, etc., stored in the ballasts/drivers 200), and/or a dimming profile index value 232*c* indicating a predefined index within a dimming profile to be used by the at least one lighting ballast or driver 200. For instance, where one or more of the ballasts/drivers 200 are configured for profile control based on time of day or time from initial powerup, and power from the source 4 is interrupted briefly, the transmitter 100 can send a profile index to set the ballasts/drivers 200 to resume profile control operation at the index corresponding to the current time, rather than reverting to the beginning of the profiles. Thus, for instance, a given profile can include a certain number of "indexes" corresponding to defined portions of the profile, with the transmit controller 110 having the ability to set one or more ballasts/drivers 200 to any desired index at any time.

As further shown in FIG. 2, the transmit controller 110 in certain embodiments is operative to enter the transmit mode to transmit the binary message 410 to the ballasts/drivers 200 in response to an input received from various sources. For instance, the control transmitter 100 may include or be operatively coupled with one or more sensors such as an ambient light sensor 140*a* (e.g. a photo sensor) and/or an occupancy sensor 140*b*, either of which may provide an input to the controller 110 to initiate transmission of a given message 410 to one or more ballasts/drivers 200. Also or in combination, the transmitter 100 may include or be operatively coupled with a user interface, such as a touch screen or user buttons 140*c* that provide a control input to the microcontroller 110 to cause the transmitter 100 to send a corresponding message 410 to the ballasts/drivers 200. Moreover, the transmitter apparatus 100 can be configured to enter the transmit mode to transmit the binary message 410 to the at least one lighting ballast or driver 200 responsive to an input from a user interface 140*c*. When daylight harvesting, occupancy sensing, (or perhaps other external sensing) is to be used, the transmitter 100 can use messaging 400 to periodically update the power output control levels of the ballasts/drivers 200 (or individual ones if addressing is used) according to the sensor input or the sensor input and the current time. In certain embodiments, the messaging 400 is sent by the transmitter 100 when the sensor or other input indicates that a significant change has occurred in order to limiting the amount of information traffic on the power line 4*c*. In other embodiments, the message 400 is sent by the transmitter 100 at routine intervals regardless whether or not there has been a change in status. When a photo sensor 140*a* is used, a user interface 140*c* can be used to set the sensitivity or profile response of the ballasts/drivers 200 as a function of sensed light input, for example, using a linear default profile with an adjustable slope, or more sophisticated profiles could be set by a user, depending on the implementation of the transmitter 100.

The apparatus 100 in certain embodiments may also includes a communications interface 130 operatively coupled with the transmit controller 110 for communications with an external device 140*d*, such as a personal computer, PDA, cell phone, etc. In certain embodiments, the interface 130 connects to the external device via a terminal 100*c*, such as a cable for serial or parallel communications or data transfer. Also or in combination, the interface 130 may include wireless (e.g., RF) communications components allowing communication with an RF equipped device 140*d*. Using this interface 130, a user may configure the ballasts/drivers 200 by providing configuration information (e.g., setpoints, control profiles, indexes, etc.), with the control transmitter apparatus 100 operating as a data intermediary.

The transmitter apparatus 100 is thus able to transmit a binary message 410 including a plurality of bits via the first power connection 4*c* to the ballasts or drivers 200 by selective power interruption. As shown in FIG. 1, the receivers 230 in the ballasts/drivers 200 detect these interruptions and decode the received messages 410 according to the interruptions.

Referring also to FIG. 3, an exemplary ballast/driver 200 is shown including a main power conversion system 210 with a controller 220, as well as a receiver 230. The main power conversion system 210 is operatively coupled with the lighting system power connections 4*c* (line) and 4*b* (neutral), and includes one or more power conversion components. The device 200 in certain embodiments is a ballast, with the main power conversion system 210 having a rectifier 214 receiving AC input power through an optional EMI filter 212 and providing an initial DC output to a power factor correcting (PFC) DC to DC converter 216. The converter 216 provides a DC output to an inverter 218, which converts the DC to provide AC output power to one or more lamps 250, such as fluorescent or HID lamp devices. In other embodiments, the apparatus 200 is an LED driver and the main power conversion system 210 need not include the inverter 218. In this case, the DC to DC converter 216 provides DC output power to drive one or more LED arrays 250. In both situations, a controller 220 is provided to regulate the output power by controlling one or both of the DC to DC converter 216 and/or the inverter 218.

As further shown in FIG. 3, the ballast/driver 200 includes a receiver system 230 operatively coupled with the main power conversion system 210 and with one or both of the lighting system power connections 4*c* and 4*h*. In the illustrated embodiment, a power circuit 236 converts DC power from the rectifier output to generate circuit power (e.g., 3.3 or 5 volt DC) to power a receiver controller 232 which may be implemented as a processing element (e.g., micro-controller, microprocessor, logic, associated memory, etc.). In certain embodiments, a signal conditioning circuit 234 is provided to interface the power line connections 4*b*, 4*c* with the receiver controller 232, which may be a microcontroller, or other programmable or configurable hardware. In certain embodiments, the power controller 220 and the receiver controller 232 may be integrated, such as a single microcontroller (e.g., PIC12F683SN microcontroller from Microchip Technology in one embodiment) that detects interruptions of a predetermined time period in the received AC power from terminals 4*b* and 4*c* and which decodes received messages and controls the output of the DC to DC converter 216 and/or that of the inverter 218. The receiver controller 232 receives the data from the power line connection(s) 4*b*, 4*c* and communicates with the ballast/driver controller 220, for instance, to provide the controller 220 with received setpoints, dimming values, profiles, profile indexes, etc.

The ballast/driver controller 220 controls operation of one or more power conversion components 214, 216, 218 according to the provided setpoints, profiles. Although the receiver 230 is illustrated as being integral with the ballast or driver 200, other embodiments are possible in which the receiver 230 is separately housed for use in providing a setpoint to any form of lighting power controller 220. For instance, a separate receiver 230 could be operatively coupled with a dimmable E/M ballast, and the above described communication techniques could be used to control the light output. For example, the receiver controller 232 could be used to (on-command) close a dry contact of the ballast that switches a capacitor into a CWA equipped HID fixture to change light level. In the embodiment of FIG. 3, moreover, the dimming is achieved by adjusting the reference level in the power regulator 220 using a PWM output of the microcontroller 232 and a low pass filter circuit (not shown) to implement an inexpensive D/A conversion to provide an analog setpoint to the power controller 220 for controlling the output power setpoint.

In operation, the receiver 230 detects interruptions of a predetermined time period T(+), T(−) in at least one portion of AC cycles in power received from the power connection 4*c*, and the controller 232 decodes message data bits of different binary states at least partially according to the interruptions and provides the decoded message data to the ballast or driver controller 220. As shown in FIG. 7, for example, the signal conditioning circuit 212 in one example includes a filter circuit and the filtered signal is provided to a digital input of the microcontroller 232. For uninterrupted sinusoidal AC input cycles, the digital value received by the microcontroller 232 appears as a square wave of approximately 50% duty cycle (e.g., logic high for 8.33 ms and logic low for 8.33 ms). The controller 232 is programmed to utilize an internal counter to determine the time that the signal remains logic high, and if this time falls below a predetermined threshold (e.g., a counter equivalent of about 6 ms in one embodiment), the controller 232 determines that the cycle has been interrupted by the control transmitter 100 of FIGS. 1 and 2. In this case, the controller 232 assigns a binary "0" to a bit position corresponding to the current AC input cycle. If instead, the count value is above the threshold, the bit is assigned a binary "1" state. In this manner, the controller 232 interprets the decoded message 410 in FIG. 7 as 01010011. The controller 232, moreover, uses the presence of predefined prefixes 412, such as 0101, 0110, and 0010 shown in FIG. 7 to identify the beginning of an incoming message and to determine the nature (type) of the subsequent data 414. As seen in the example of FIG. 3, the controller 232 can store the received control values for dimming level 232*a*, dimming profile 232*b* and/or profile index 232*c* and provides a setpoint value to the ballast/driver controller 220 accordingly. In certain embodiments, moreover, the messaging can include one or more address fields and the individual ballasts/drivers 200 can store preconfigured addresses allowing the control transmitter 100 to send individualized control data or information to specific ballasts/drivers 200 through the power line connection(s).

It is further noted that the above described apparatus could be used in systems using different line frequencies, and may also be implemented to allow universal line voltage levels such as 120-277 VAC. In certain embodiments, each receiver 230 can utilize counters and inputs to initially measure the period of the line cycle, and can be configured to set a communications threshold count value as a percentage of the measured line period to thereby self-adapt to the prevailing line frequency after a short interval of operation following power-up. If the receiver 230 is equipped with non-volatile memory, this measured period and threshold value can be retained for future use.

The above examples are merely illustrative of several possible embodiments of various aspects of the present disclosure, wherein equivalent alterations and/or modifications will occur to others skilled in the art upon reading and understanding this specification and the annexed drawings. In particular regard to the various functions performed by the above described components (assemblies, devices, systems, circuits, and the like), the terms (including a reference to a "means") used to describe such components are intended to correspond, unless otherwise indicated, to any component, such as hardware, processor-executed software, or combinations thereof, which performs the specified function of the described component (i.e., that is functionally equivalent), even though not structurally equivalent to the disclosed structure which performs the function in the illustrated implementations of the disclosure. In addition, although a particular feature of the disclosure may have been illustrated and/or described with respect to only one of several implementations, such feature may be combined with one or more other features of the other implementations as may be desired and advantageous for any given or particular application. Furthermore, references to singular components or items are intended, unless otherwise specified, to encompass two or more such components or items. Also, to the extent that the terms "including", "includes", "having", "has", "with", or variants thereof are used in the detailed description and/or in the claims, such terms are intended to be inclusive in a manner similar to the term "comprising". The invention has been described with reference to the preferred embodiments. Obviously, modifications and alterations will occur to others upon reading and understanding the preceding detailed description. It is intended that the invention be construed as including all such modifications and alterations.

The following is claimed:

1. A transmitter apparatus for communicating with a ballast or driver through at least one power connection in a lighting system, comprising:

a first terminal coupled with a first output of an AC power source;

a second terminal coupled with a first power connection, the first power connection being coupled with at least one lighting ballast or driver;

a switching circuit coupled between the first terminal and the second terminal, the switching circuit operable according to a switching control signal to selectively electrically couple the first terminal to the second terminal in a first state and to electrically decouple the first terminal from the second terminal in a second state;

a transmit controller operative in a transmit mode to transmit a binary message including a plurality of bits via the first power connection to the at least one lighting ballast or driver, the transmit controller being operative to transmit bits of a first binary state by providing the switching control signal to selectively place the switching circuit in the second state for a predetermined time period to interrupt provision of power from the AC power source to the at least one lighting ballast or driver in at least one portion of select AC input cycles; and a second switching circuit coupled between the first terminal and the second terminal, the second switching circuit operable according to a second switching control signal to selectively electrically couple the first terminal to the second terminal in a first state, the transmit controller being operative in a bypass mode to provide the second switching control signal to selectively place the second switching circuit in the first state to connect the AC power source to the at least one lighting ballast or driver.

2. The transmitter apparatus of claim 1, the transmit controller being operative to transmit bits of a second binary state by providing the switching control signal to maintain the switching circuit in the first state to allow provision of power from the AC power source to the at least one lighting ballast or driver.

3. The transmitter apparatus of claim 1, the transmit controller being operative to transmit bits of the first binary state by providing the switching control signal to selectively place the switching circuit in the second state for a predetermined time period to interrupt provision of power from the AC power source to the at least one lighting ballast or driver in portions of both half-cycles of the select AC input cycles.

4. The transmitter apparatus of claim 1, the transmit controller being operative in the transmit mode to transmit the binary message with each bit of the message corresponding to an AC input cycle.

5. The transmitter apparatus of claim 4, the transmit controller being operative in the transmit mode to transmit bits of the first binary state by providing the switching control signal to selectively place the switching circuit in the second state for a predetermined time period to interrupt provision of power from the AC power source to the at least one lighting ballast or driver in at least one portion of the select AC input cycles, the at least one portion of the select AC input cycles being synchronized with a zero crossing of the power from the AC power source.

6. The transmitter apparatus of claim 5, comprising a sync circuit operatively coupled with the first terminal and operative to provide a sync signal to the transmit controller indicative of a zero crossing of the power from the AC power source.

7. The transmitter apparatus of claim 1, the transmit controller being operative in the transmit mode to transmit bits of the first binary state by providing the switching control signal to selectively place the switching circuit in the second state for a predetermined time period to interrupt provision of power from the AC power source to the at least one lighting ballast or driver in at least one portion of the select AC input cycles, the at least one portion of the select AC input cycles being synchronized with a zero crossing of the power from the AC power source.

8. The transmitter apparatus of claim 7, comprising a sync circuit operatively coupled with the first terminal and operative to provide a sync signal to the transmit controller indicative of a zero crossing of the power from the AC power source.

9. The transmitter apparatus of claim 1, the transmit controller being operative in the transmit mode to transmit the binary message including at least one dimming level value indicating a dimming level to be used by the at least one lighting ballast or driver.

10. The transmitter apparatus of claim 1, the transmit controller being operative in the transmit mode to transmit the binary message including at least one dimming profile value indicating a predefined dimming profile to be used by the at least one lighting ballast or driver.

11. The transmitter apparatus of claim 1, the transmit controller being operative in the transmit mode to transmit the binary message including at least one dimming profile index value indicating a predefined index within a dimming profile to be used by the at least one lighting ballast or driver.

12. The transmitter apparatus of claim 1, the transmit controller being operative in the transmit mode to transmit the binary message including a prefix portion and a data portion, the prefix portion indicating a type of data included in the data portion.

13. The transmitter apparatus of claim 1, the transmit controller being operative to enter the transmit mode to transmit the binary message to the at least one lighting ballast or driver responsive to an input from at least one sensor.

14. The transmitter apparatus of claim 1, the transmit controller being operative to enter the transmit mode to transmit the binary message to the at least one lighting ballast or driver responsive to an input from a user interface.

15. The transmitter apparatus of claim 1, comprising a communications interface operatively coupled with the transmit controller for communications with an external device.

16. A lighting system ballast or driver apparatus, comprising:

a main power conversion system operatively coupled with a plurality of lighting system power connections, the main power conversion system comprising:

at least one power conversion component operative to selectively convert power received from the lighting system power connections to provide power to at least one light source, and a ballast or driver controller operative to control operation of the at least one power conversion component; and a receiver operatively coupled with at least one lighting system power connection to detect interruptions of a predetermined time period in at least one portion of AC cycles in power received from the least one lighting system power connection, the receiver comprising a receiver controller operative to decode message data bits of different binary states based at least partially on the interruptions and to provide decoded message data to the ballast or driver controller, where the receiver controller is operative to provide the decoded message data including at least one dimming profile index value indicating a predefined index within a dimming profile to the ballast or driver controller.

17. The ballast or driver apparatus of claim 16, where the receiver controller is operative to decode interrupted AC cycles as bits of a first binary state and to decode uninterrupted AC cycles as bits of a second binary state with each bit of the message corresponding to an AC input cycle.

18. The ballast or driver apparatus of claim 16, where the receiver controller is operative to provide the decoded message data including at least one dimming level value indicating a dimming level to the ballast or driver controller.

19. The ballast or driver apparatus of claim 16, where the receiver controller is operative to provide the decoded message data including at least one dimming profile value indicating a predefined dimming profile to the ballast or driver controller.

20. The ballast or driver apparatus of claim 16, where the receiver controller is operative to provide the decoded message data to the ballast or driver controller including a prefix portion and a data portion, the prefix portion indicating a type of data included in the data portion.

21. The ballast or driver apparatus of claim 16, where the apparatus is a lighting system ballast, and where the main power conversion system comprises an inverter operative to provide AC power to at least one lamp.

22. The lighting system ballast or driver apparatus of claim 16, where the apparatus is a lighting system driver, and where the main power conversion system comprises a DC to DC converter operative to provide DC power to at least one LED array.

23. The lighting system ballast or driver apparatus of claim 16, wherein the receiver is operative to store at least one dimming profile defining a set of predefined setpoint dimming levels and corresponding dwell times and ramp portions, and at least one dimming profile index value indicating a predefined index defining a specific portion within the at least one dimming profile, and where the receiver controller is operative to provide the decoded message data including at least one dimming profile index value indicating the predefined index within the at least one dimming profile to the ballast or driver controller.

24. The transmitter apparatus of claim 10, wherein the at least one dimming profile value indicates the predefined dimming profile defining a set of predefined setpoint dimming levels and corresponding dwell times and ramp portions to be used by the at least one lighting ballast or driver.

25. The transmitter apparatus of claim 11, wherein the at least one dimming profile index value defines a specific portion within the dimming profile to be used by the at least one lighting ballast or driver.

26. A transmitter apparatus for communicating with a ballast or driver through at least one power connection in a lighting system, comprising:

a first terminal coupled with a first output of an AC power source;

a second terminal coupled with a first power connection, the first power connection being coupled with at least one lighting ballast or driver;

a switching circuit coupled between the first terminal and the second terminal, the switching circuit operable according to a switching control signal to selectively electrically couple the first terminal to the second terminal in a first state and to electrically decouple the first terminal from the second terminal in a second state; and a transmit controller operative in a transmit mode to transmit a binary message including a plurality of bits via the first power connection to the at least one lighting ballast or driver, the transmit controller being operative to transmit bits of a first binary state by providing the switching control signal to selectively place the switching circuit in the second state for a predetermined time period to interrupt provision of power from the AC power source to the at least one lighting ballast or driver in at least one portion of select AC input cycles, the transmit controller being operative in the transmit mode to transmit the binary message including at least one dimming profile index value indicating a predefined index within a dimming profile to be used by the at least one lighting ballast or driver.

27. The transmitter apparatus of claim 26, the transmit controller being operative in the transmit mode to transmit the binary message including at least one dimming level value indicating a dimming level to be used by the at least one lighting ballast or driver.

28. The transmitter apparatus of claim 26, the transmit controller being operative in the transmit mode to transmit the binary message including at least one dimming profile value indicating a predefined dimming profile to be used by the at least one lighting ballast or driver.

29. The transmitter apparatus of claim 28, wherein the at least one dimming profile value indicates the predefined dimming profile defining a set of predefined setpoint dimming levels and corresponding dwell times and ramp portions to be used by the at least one lighting ballast or driver.

30. The transmitter apparatus of claim 26, the transmit controller being operative to enter the transmit mode to transmit the binary message to the at least one lighting ballast or driver responsive to an input from at least one sensor.

31. The transmitter apparatus of claim 26, wherein the at least one dimming profile index value defines a specific portion within the dimming profile to be used by the at least one lighting ballast or driver.

* * * * *